United States Patent [19]

Phalin et al.

[11] Patent Number: 4,502,313

[45] Date of Patent: Mar. 5, 1985

[54] TOOLING ADJUSTMENT

[75] Inventors: Thomas L. Phalin, Cary; James J. Ulmes, Palatine, both of Ill.

[73] Assignee: American Can Company, Greenwich, Conn.

[21] Appl. No.: 377,331

[22] Filed: May 12, 1982

[51] Int. Cl.[3] ..... B21B 22/00

[52] U.S. Cl. ..... 72/342; 72/349; 72/364

[58] Field of Search ..... 72/342, 364, 347, 348, 72/349

[56] References Cited

U.S. PATENT DOCUMENTS

| | | | |
|---|---|---|---|
| 3,559,447 | 2/1971 | Bogoit | 72/342 |
| 3,577,753 | 5/1971 | Shoh et al. | 72/342 |
| 3,924,437 | 12/1975 | Hortig | 72/349 |
| 4,148,208 | 4/1979 | Maeder | 72/342 |

FOREIGN PATENT DOCUMENTS

| | | |
|---|---|---|
| 625011 | 2/1950 | United Kingdom . |
| 1327188 | 8/1973 | United Kingdom . |
| 1345227 | 1/1974 | United Kingdom . |
| 1509905 | 5/1978 | United Kingdom . |

*Primary Examiner*—Leon Gilden

*Attorney, Agent, or Firm*—Paul R. Audet

[57] ABSTRACT

An apparatus for drawing and ironing a cup with a peripheral flange from relatively thin material into an elongated container also having a flange by moving a die and punch relative to one another and draw clamping and centering sleeve coaxial therewith and thereafter applying a bottom forming member axially relative to the die against the punch to profile shape said container bottom without the benefit of coolant flooding of said material during drawing and ironing, the improvement comprising; a die of a predetermined shape and size carried in the apparatus, a punch of a predetermined shape and size for cooperating with said die and each having surfaces which define a clearance therebetween during forming of said material; separate passages through said die means and said punch means to permit flow of coolant; valving in line with die and punch passages for independent control of the coolant flow from a supply means to said die and punch to permit regulation of the operating temperature of said die means with respect to said punch means to increase or decrease said clearance therebetween by moving said surfaces toward or away from one another during the drawing and ironing of said material into an elongated container.

7 Claims, 7 Drawing Figures

TOOLING ADJUSTMENT

BACKGROUND OF THE DISCLOSURE

For the last 25 years, work has progressed on manufacturing drawn cans for food product. These containers were made of materials such as aluminum and low temper steels in order to facilitate the drawing operation. In addition to this the containers usually had a height about equal to or less than the diameter of the container and were fashioned in one or two drawing operations.

Only recently has it been possible to make multiple drawn two piece food containers which were fashioned from organically precoated tin free steel such that postcoating or post treatment operations were not necessary. More particularly, a 24 oz. 404×307 tin free steel container was made in a two draw operation. (The can makers convention gives the diameter across the completed doubleseam in inches plus sixteenths of an inch then the height in inches plus sixteenths of an inch. Therefore, the foregoing container is 4 4/16" in diameter by 3 7/16" in height). It is desired to be able to make a container whose height is appreciably greater than the diameter, using precoated starting material in a multiple draw process. It is also desired to make such a container in the popular 16 oz. 303×406 size or the 15 oz. 300×407 size or the 11 oz. 211×400 size.

A triple draw process is required to make the foregoing containers, and that process tends to thicken the area of the container side wall near the open end. The amount of thickening increases from the bottom of the container to the top and all the way to the tip of the flange. This thickening is a consequence of the drawing of the material from a flat disc-shape and the variable circumferential compression of the material as a function of its distance from the bottom of the ultimately formed cup. The additional material thickness at the top of the container serves no useful purpose, and is a waste of material increasing the weight and cost of the container.

The preferred container is fashioned from double reduced plate and more specifically from plate of DR9 temper and about 65# per base box base weight. DR9 is a tin mill product specification which relates to the process by which the metal is cold reduced in two stages with an anneal preformed between the two cold rolling operations. The steel is reduced approximately 89% in the first reduction, is annealled, and then is reduced about 25 to 40% in the second and final cold reduction. The base box terminology for base weight is standard in the can making industry; it originally referred to the amount of steel in a base box of tinplate consisting of 112 sheets of steel 14"×20", or 31,360 square inches plate. Today the base box as related to base weight refers to the amount of steel in 31,360 square inches of steel, whether in the form of coil or cut sheets. The preferred embodiment can be made from tin free steel (TFS), tinplate, nickel plated steel, or steel base material.

This material may be coated on what ultimately will be the outside surface by an epoxide-resin-type or an organosol coating. The inside may be coated with a coating consisting of a combination of resins of the organosol type. Inside and outside coatings are capable of withstanding the drawing and ironing stresses typical of can-making operations. Consequently, the container can be made from a relatively high temper material and should not require a postcoating. Of course, tinplate which is not organically cated will require at least an internal postcoating operation.

The outside coating is applied by roller coating or coil coating and cured in an oven. For sheet coating operations, this coating is baked in a temperature range of 300° to 400° for about 6 to 10 minutes. It is usually applied to the metal substrate at a film weight of 8 to 15 mg per 4 square inches of plate area. The outside coating can be of several chemical types such as a vinyl organosol, an epoxide resin, an amine resin, a phenolic resin or suitably formulated blends of these resins. The inside coating is generally applied at a film weight of 15 to 35 mg per 4 square inches of plate area; that coating can be either sheet coated or coil coated. A baking temperature of 300° to 400° F. for 8 to 10 minutes is generally used in sheet coating. Inside coatings contain mixtures of phenolic resin, epoxy resin, vinyl solution resins of the vinyl acetate-vinyl chloride copolymer type and high molecular weight polyvinyl chloride dispersion resins.

The preferred method used in order to produce such a desired container having a minimum amount of the high temper DR9 steel, includes three drawing operations which may take place in a press such as that disclosed in U.S. Pat. No. 4,262,510 which is assigned to the same Company as the present invention. For a triple drawn and ironed can the diameter of the container and the wall thickness are concurrently reduced in each forming operation. More specifically, the first operation blanks and forms the sheet of precoated material into a shallow cup wherein the diameter is in excess of the height. During this operation the wall thickness is reduced by ironing while drawing such that part of the wall is reduced to less than the thickness of an unironed container. The second operation redraws the container and reduces the diameter and again concurrently irons the wall to similarly reduce thickness from the top to the bottom. In this second operation the diameter is reduced and the height increased so that they are about equal. The final operation reduces the diameter still further and once again concurrently irons the side wall to produce a preferred thinness and uniformity such that the container achieves its final configuration with a sidewall which is about 0.001" less than the starting gauge before bottom profile and sidewall beading.

In any of the multiple operations where the diameter is reduced and the side wall is thinned the ironing operation may be stopped before it reaches the flange. Consequently, the flange thickness as well as the side wall area next adjacent the flange can be left thicker. It should be appreciated that a complete container can be manufactured from precoated stock without having the need for any washing, repair postcoating or additional energy-intensive operations.

The addition of ironing to the multiple-draw process permits the original cutedge or circular blank to have a smaller diameter than that necessary for an unironed similar size container. Therefore, the amount of steel used for this container is less than that needed for drawn containers of the same size. This reduction in steel saves material and reduces the ultimate container weight.

During forming at high levels of pressure, heat is generated. Lubrication topically applied to the coating is a critical aspect for forming multiple drawn and ironed containers. The lubricant provides the needed slip properties when precoated plate is formed in the press tooling. Without proper lubrication, the coatings will be scraped off by the press tools resulting in scuffing, drawing failures and possible damage to the punches and dies in the press. Lubricants such as Boler wax, lanolin or petrolatum can be used. For multiple drawn containers, petrolatum is the best with regard to tool lubrication, good flavor performance, price and stability. The lubricant can be topically applied by spraying from standard spray guns, fogging by special electrostatic machines over the coated plate or by mixing the lubricant into the coating.

The lubricant must be able to work under both the heat and pressure in order to protect the coating and metal combination from destruction. The mechanical working of the precoated metal in the dies of the press causes a rise in temperature of the precoating and metal as they are formed into containers. Temperatures in the press tooling and consequently in the containers at least at the interface rise to 150° F. in the first redraw station and reach as high as 200° F. in the second redraw station, but temperatures as high as 280° F. have been measured. In addition to or instead of topical lubricants dry film type lubricants can be dispersed in solvent and incorporated in the coating. During the forming operations, the dry film lubricant becomes available at the heated interface as a hard, solid protective layer. It is essential that the melting point of the solid lubricant be adjusted to cooperate with the levels of heat existing during the multiple forming steps whereby the lubricant first becomes available in a flowable form at the time when the temperature exceeds a predetermined level.

A working temperature is ultimately arrived at during the multiple forming operations and contrary to drawing and ironing of beverage containers there is no coolant/lubricant flood of the containers and tooling used to form sanitary food cans. The flooding of the containers and tooling requires that the containers be cleaned by washing and drying after forming. Here, there is disclosed an essentially clean dry process which provides a container which is ready to be packed and processed. Of course, the foregoing relates primarily to organically precoated stock and not necessarily to unorganically coated tinplate. The working temperature is a result of the process parameters, the tooling design, material used and other factors that influence the pressure applied during forming.

Traditionally, any variation in plate gauge, hardness or temper which affected the drawability had to be overcome by different punch and die dimensions. In particular, a few 0.0001" in the clearance between the punch and die (for a drawn and ironed container diameter in the range of 2½ to 5") could substantially affect the outcome of a drawing and ironing process. Metal tends to be a resistant to thinning during the plastic deformation resulting from drawing. In a multiple draw/redraw process with ironing, the resistance to thinning will affect the ultimate container volume because as the metal is thinned it elongates resulting in greater side wall height. Similarly, the plate gauge varies throughout a coil thus affecting the ultimately container size. In a two-piece container the height and volume are critical in that each container must be of uniform size in order to properly pass through existing conveyors, processing and labeling equipment.

From the foregoing it is clear that the process used to multiple form drawn and ironed food containers generates a sufficient amount of heat and working pressure to cause uncontrolled dimensional changes in the tooling. These changes are critical to the overall container shape and more specifically, to the variations in ultimate height, volume, side wall condition, bottom profile integrity and flange length before trimming from one container to another. The untrimmed flange length at any given circumferential portion thereof is also a function of the original material gauge and the grain direction established during the rolling of the sheet. Consequently, if the metal is high earing the flange will be extended radially at all points which are about 45° to the grain direction to an extent which is wasteful of material and harmful to the process. Conversely, low earing metal will not extend as far. Light gauge metal will tend to have a short or narrow flange in a radial direction normal to the direction of the grain. This minimum radial extent could result in incomplete trimmed rings such that they will be unmanageable and/or the flange too short.

Also, low temper steel and/or a heavy plate gauge and/or plate with low levels of lubricants produce large flanges causing wrinkling about the circumferential flange periphery. That wrinkling has difficulty in flowing past the clamping sleeve through the tooling between the punch and die. More particularly, the uncontrolled wrinkling of the flange periphery locks against the clamping sleeve which is designed to control the feed of the metal to a prescribed rate. Locking puts excessive stress on the side wall during drawing and/or on the bottom during profiling. That stress causes tearouts in the side wall and breakouts in the bottom wall. More specifically, the feeding of the material into the die as a result of being drawn by the punch is not uniform and not controlled because of the locking due to wrinkling about the extended flange periphery.

In a high speed draw/redraw food container multiple forming operation at speeds of 100 containers per minute or higher the variables which will determine the quality of the container produced are many and are changing with respect to time. It is therefore essential to such a commercial operation to be able to accurately control the process and consequently the results by some means. It is the object of the disclosure to present the technique, method and apparatus discovered which permits the stated problems to be resolved.

OBJECTS OF THE DISCLOSURE

It is an object ot this invention to radially adjust the tooling dimensions during operation to overcome running material and operational changes which will affect the container and trim size and quality.

It is another object of the present invention to overcome the difficulties of having gauge tolerances which affect the length of the untrimmed flange and container volume.

It is still a further object of the present invention to disclose a method by which the amount of flange wrinkling can be controlled.

It is yet another feature of the present invention to show an inexpensive, expedient and practical means by which the container volume and flange length can be adjusted in a high speed commercial drawing and ironing food can manufacturing process.

SUMMARY OF THE DISCLOSURE

The present inventions deals with thin metal plate having a thickness or gauge tolerances of ±5% from the ideal or aim gauge necessary for reliable continuous multiple forming operations. In the past the maximum gauge tolerance feasible for producing acceptable containers without excessive flange, incorrect volume, clip-offs, breakouts, tearouts and the like was about ±3% from the ideal gauge. The ±3% tolerance is necessitated by the recognition that in a high speed commercial operation the eccentricity of the tooling relative to its axis varies such that the trim rings become offset or eccentric with respect to the trimmed containers. Similarly, uneven clamping affects the control of the metal drawn through the die giving eccentric trim rings. During normal startup the normalization of tooling temperature results in a decrease in the amount of trim. This contricity problem coupled with the plate gauge tolerance means that the ±3% is critical unless other measures are taken. The present disclosure deals with those other measures which permit the plate gauge tolerances to be raised to at least as high as ±5%.

The ideal gauge of 65# plate is 0.00715 inches and with a ±5% tolerance gives a gauge variation from 0.0068" to 0.0075". The difference between precoated plate and plain plate gauge is about 0.0004" so that the thickness with ±5% gauge tolerance for precoated plate is 0.0072" to 0.0079". More specifically, selective water cooling of the punches and/or dies can be used to control the dimensions of the punches with respect to the dies. Water passages provided to permit cooling water to flow through the tooling will help control the clearance between the punch and die sufficiently to handle the ±5% gauge tolerance.

The flange length is also a function of the temperature of the tooling since the dimensions of the tooling vary with temperatuer resulting in fluctuations in the loading applied to the metal. Temperature increases in the punch, or decreased in die result in greater untrimmed flange size length and larger container volume. Similarly, minimum trim length correlates with decreasing punch temperature and increased die temperature with lighter plate gauge, and specifically as the gauge decreases so does the amount of trim. When the tooling is cool or at room temperature, the cans which are drawn and ironed have large or excessive trim rings. If the tools are allowed to heat up by restriction of the flow of the cooling water or increasing the temperature of the cooling water, the trim rings diminish in size. This results because the metal flow or drawability improves permitting more metal to flow into the side and bottom of the container. This improved flow decreases stress induced in the container during forming thus minimizing the potential for breakouts or tearouts. Of course, the metal consumption can be reduced by increasing the amount of cooling but at the risk of greatr stress in the can side and bottom. It becomes a balance as to obtaining the maximum use of material at the minimum stress while keeping the trim a container size within the range which is considered normal.

The preferred embodiment in a typical press of the type described for making ironed cans in a multiple drawing and ironing process, has chilled water of about 40° F. flowing through the dies from one supply connection and through the punches from another separate supply connection. Consequently, the temperature of either the punches or the dies or both can be controlled. For example, restriction of the water flow through the punches will increase the amount of ironing as the punches heat up and expand. Similarly, increasing the flow of coolant through the punches will prevent them from expanding in a radial direction and cut down the amount of ironing which takes place as the dies warm up and expand. Similarly, increasing the flow of coolant through the die decreases the temperatures of the die which increases the amount of ironing, obviously increasing the temperature of the water used for cooling will have the same affect as decreasing the flow and alternatively lowering the temperature has the same effect as increasing the flow because the tooling tends to warm up as a result of the operation. Tooling temperature adjustments are made by valving the flow, changing the temperature of the coolant, or a combination of both. Of course, adjusting the flow with valves is simpler and tends to give a quicker response.

The effect of being able to adjust the clearance between the punches and dies is best appreciated when one understands that running changes can be made which will permit the tooling to be adjusted for plate gauge tolerances, drawability, die alignment plate, temper and lubrication effects. Another factor arising from the effects of temperature control of the die is the variation of the preload on the carbide die insert. With temperature increase the steel portion of the tool is expanded radially and the preload decreases. This has a direct affect on increasing clearance between the punch and die.

Lubrication level also effects the trim ring dimensions. With high levels of lubricants either topically applied or in the coating, small trim rings are obtained since the metal flow or drawability is improved. Conversely, low lubrication levels produce large trim rings as the stress of the process is increased and the flow of metal is inhibited. The preferred lubrication rate is 17 to 21 mg per square foot ±7 mg per square foot on the inside and outside of the container when petrolatum is used as lubricant. Similarly, temper will affect the trim ring dimensions. Low temper steel has a low tensile strength and thus gives long trim rings as the metal elongation is greater. High temper metal produces short trim rings since the tensile strength is high and the stress elongation is low.

The preferred drawing and ironing process seeks to produce containers with uniform height having a tolerance of ±0.0001". It is, therefore, important to be able to quickly and easily adjust the process to meet the parameters of the material so that the resulting containers are uniform.

DETAILED DESCRIPTION OF THE DRAWINGS AND DISCLOSURE OF THE INVENTION

Figure 1:
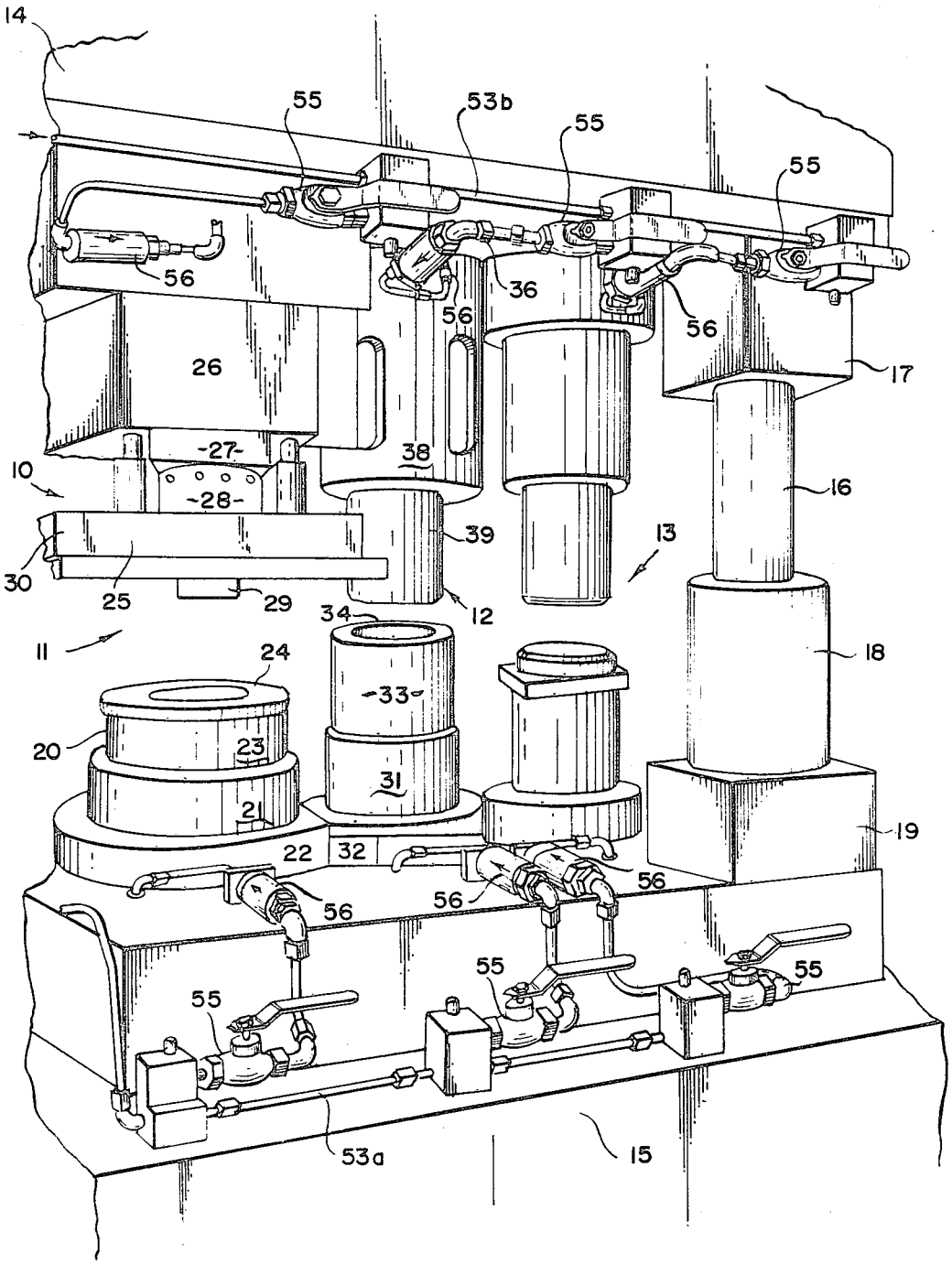
FIG. 1 is a partial perspective view of the apparatus of the invention in a press having three stations in which a thin sheet of metal is first blanked and cupped, then redrawn and finally redrawn again and bottom profiled.

FIG. 1 is a partial perspective view of the tooling 10 in a press wherein multiple operations take place in converting a blank sheet of a thin metallic strip into a container having a height greater than its diameter. The tooling 10 includes a blanking and cupping tool 11, a first redraw punch and die 12, and a second redraw and bottom profile tool 13. The tooling 10 is held between the crown 14 of the press and the ram 15 of the press. To support the ram 15 relative to the crown 14, there is a shown in FIG. 1 just one of several guide posts 16 which in a conventional manner is supported from the crown 14 by guide post retainers 17 so as to depend perpendicularly from the crown 14 into a lower guide bushing 18 which is affixed to the ram 15 by a bushing retainer 19. The ram 15 is thus carried within the press for guided reciprocatory movement towards and away from the crown 14 as shown by the arrow in FIG. 1.

The blanking and cupping tooling 11 consists of a blanking punch draw die assembly 20 mounted to the ram 15 by a die retainer 21 which is attached to the die shoe 22 that is directly carried on the ram 15. The die assembly 20 includes a blanking punch cutedge 23 carried atop the die retainer and designed to support and generate a blank over draw die 24. Similarly, a punch assembly 25 for the blanking and cupping tooling 11 includes a punch shoe 26, a punch retainer 27, a punch spacer 28 and a punch 29 mounted in axial relation in descending order from the crown 14. The punch 29 is surrounded by a hold down clamp 30, see FIG. 1.

Figure 3:
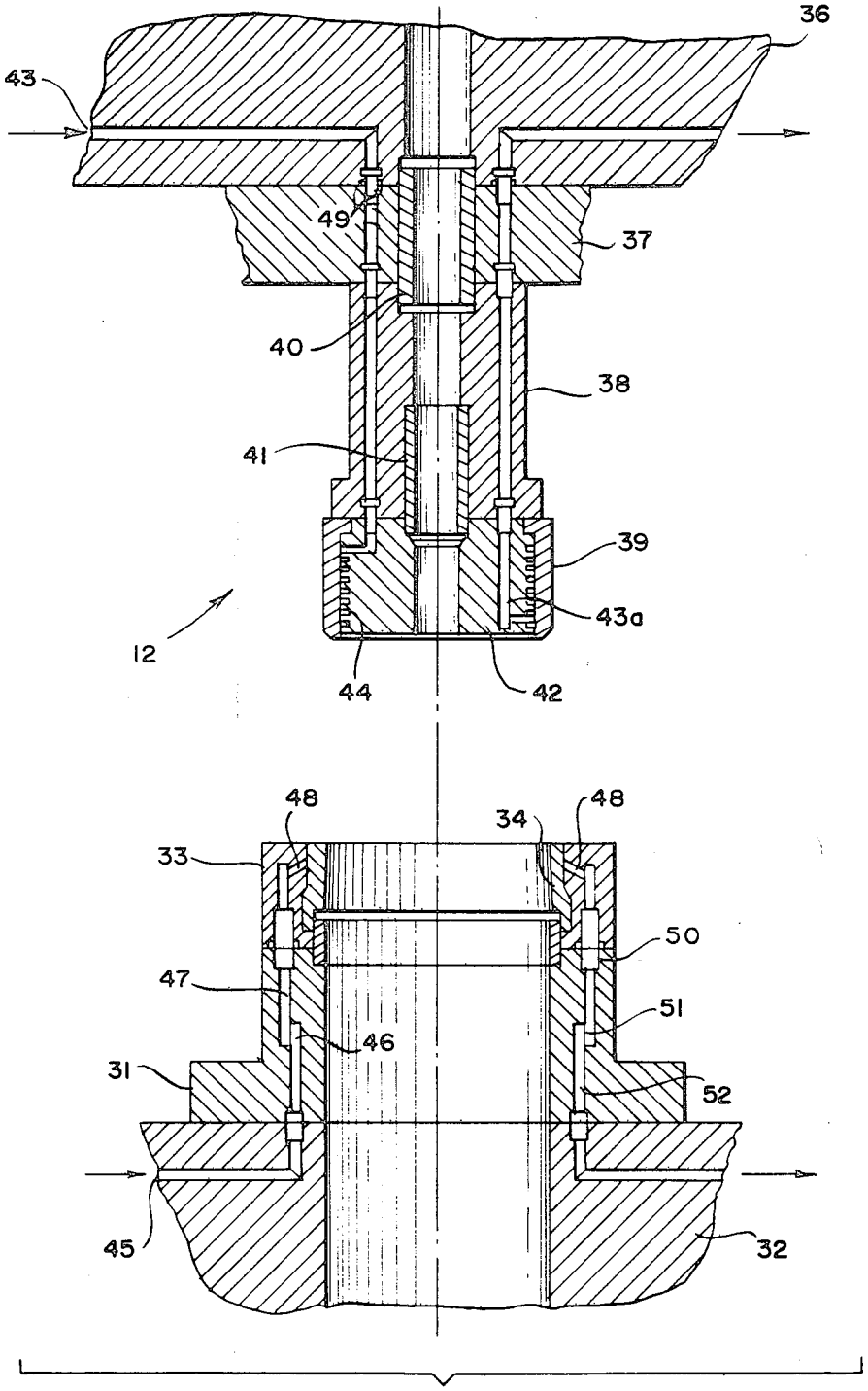
FIG. 3 is a partial side elevational view in cross section of the punch and die of the first redraw station of the apparatus of FIG. 1.

The tooling for blanking and cupping 11 and the second redraw and bottom profiling 13 are substantially identical to the first redraw tooling and as for as the present disclosure is concerned the cooling passages are substantially as shown in FIG. 3 in the other stations and only the dimensions are different with respect to the tools whereby order a different size container are foremd. The numbering applied in FIG. 3 is in connection with the first redraw station 12 and the parts which compose the punch and die members for each of the tools 11, 12, or 13 are similar in name and operation. They will only be described in detail in connection with the first redraw section shown in cross section in FIG. 3, and the alternate punch assembly of FIG. 4.

Turning to FIG. 3 which is the partial side elevational view in cross section of the first redraw tool 12 and it shows in detail the cooling passages. Specifically, there is a die retainer 31 mounted on die shoe 32 carried on a ram 15 for supporting the hollow cylindrical die ring holder 33 which holds therein the carbide draw die ring 34 in concentric coaxial alignment. The first redraw tooling 12 includes a punch assembly having a punch shoe 36, a punch retainer 37, a punch spacer 38 and, of course, the punch 39. There are a pair of cylindrical centering locating sleeves upper 40 and lower 41 which are coaxially centered within the punch portion of the first redraw operation operation 12. The lower locating sleeve 41 is held within the punch by a punch center 42 being a ring-like member disposed within the hollow confines of the punch 39. A cooling passage 43 starts in the upper left side of the punch tooling in FIG. 3 and permits coolant to flow across and down through the punch retainer 37, the punch spacer 38 and into the punch center 42. About the punch center 42 there is a series of spiral grooves in the periphery thereof labelled generally 44. The incoming coolant passage 43 supplies the spiral grooves 44 which are against the inside of the draw die 34 thus allowing the coolant to flow about the periphery of the punch center 42 and in heat conductive contact with the inside wall of the punch 39. The coolant enters the spiral groove 44 at a high elevation and in circulating the coolant progresses to the bottom of the punch center 42 where an exit passage **43*a* is provided to permit the coolant to flow upwardly through the punch center 42, punch spacer 38, punch retainer 37 and out across the punch shoe 36**.

An inlet passage 45 is provided at the left side of the die shoe 32 in FIG. 3 and passage 45 which permits the coolant flow across and then upwardly through the die shoe 32 and into the die retainer 31. The passage 45 in the die retainer 31 includes an offset portion 46 at the juncture where the passage 45 from the bottom of the die retainer 31 joins another passage 47 from the top of the die retainer 31. This offseting is needed in order to align the passage 45 and 47 so they run through the portions of the die retainer 31 with the maximum amount of material thickness. More specifically, the offset 46 for passages 45 and 47 permit the die retainer 31 to have maximum strength notwithstanding the fact that coolant passages are drilled therethrough. The passage 47 continues up through the die ring holder 33 wherein a transverse passage and inner wall groove 48 are provided to permit circumferential circulation of coolant between the inner wall of the die ring holder 33 and the mating part of draw die ring 34.

As those skilled in the art will no doubt appreciate, O-rings such as, for example, those noted at the mating surfaces between the punch shoe 36 and the punch retainer 37 and labelled 49 are included at all of the junctures between all of the components of the tooling in order to provide the fluid tight seal necessary for coolant flow without leakage of the coolant. The coolant in the punch of FIG. 3 and, in particular at the groove 48 is allowed to exit through the die ring holder 33, die retainer 31 and the die shoe 32 through a set of passages 50, 51 (again being the offset) and 52 in a manner similar to that arrangement through which of coolant was allowed to enter. This technique is used in order to maintain the strength of retainer 31. Passages 50 and 52 are apart from passages 45 and 47 to permit circulation of the coolant about the circumference of the draw ring 34.

Figure 2:
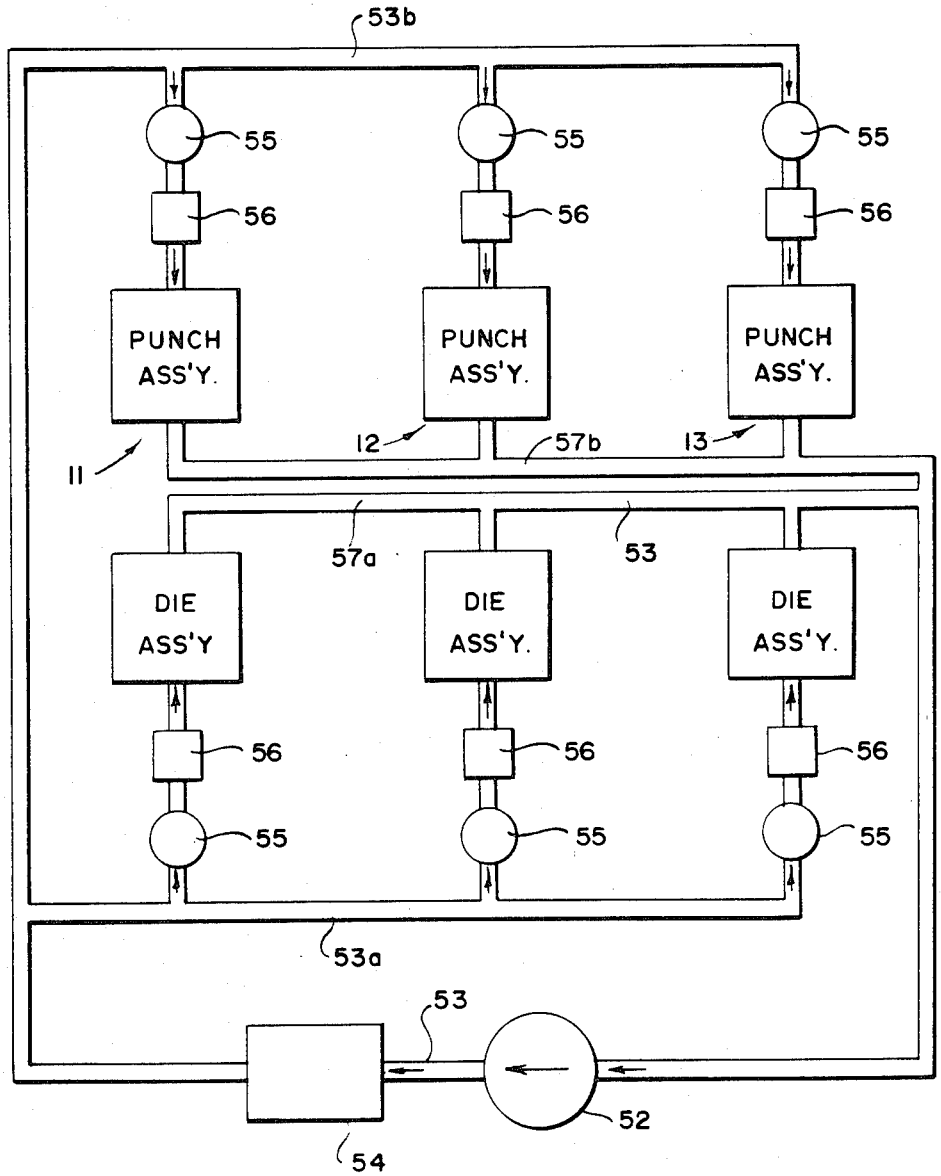
FIG. 2 is a schematic flow diagram illustrating the cooling circuits and water flow in the apparatus of FIG. 1.

Turning to FIG. 2 which is a schematic view to show the flow of coolant in a parallel type system. While the preferred embodiment incorporates a parallel type system, those skilled in the art will no doubt appreciate that in specific instances other arrangements would be feasible where the coolant flow is more important during certain stages of the forming operations than others due to increased heat buildup, for example, the second redraw operation. In FIG. 2, from left to right there is shown the tooling 11, 12 and 13 in schematic fashion. The top blocks are labelled punch assembly and represent the respective punch assemblies for the cupping and blanking tool 11, first redraw tool 12 and second redraw and bottom profiling tool 13. Similarly, the lower blocks immediately below the punch assemblies are the die assemblies for the cupping and blanking tool 11, the first redraw tool 12 and the second redraw and bottom profiling tool 13.

The coolant flow begins at a pump labelled 52 which by the piping generally labelled 53, throughout, is connected to a chiller 54 used to control the temperature of the coolant being pumped through the piping 53. In the preferred embodiment the coolant is water and the temperature 40° F. The pump 52 and the chiller 54 act to supply coolant to the respective punch and die assemblies by the respective manifold assemblies 53*a* and 53*b* for the dies and punches. As can easily be seen schematically in FIG. 2 and as can be seen pictorially in FIG. 1, the manifolding is for parallel flow. Manifolding assemblies 53*a* and 53*b* have independent connections to each of the die assemblies and each of the punch assemblies. The connections include flow control means being valves designated 55 (one for each assembly) and flow control meters 56 (one for each assembly). The valves 55 are shown pictorially in FIG. 1 and schematically in FIG. 2, and similarly, the flow meters 56 are shown pictorially in FIG. 1 and schematically in FIG. 2. Flow meters 56 are Hedland brand in-line type which are designed to measure the flow in a range of zero to two gallons per minute. Thus, it can be seen that the quantity of coolant fluid available to flow to any of the die assemblies or punch assemblies can be independently determined and regulated. Exit manifolds 57*a* and 57*b* are connected to the respective dies and punches to permit collection of the coolant fluid flow therethrough and the return of same by piping 53 to the inlet of the pump 52.

Figure 4:
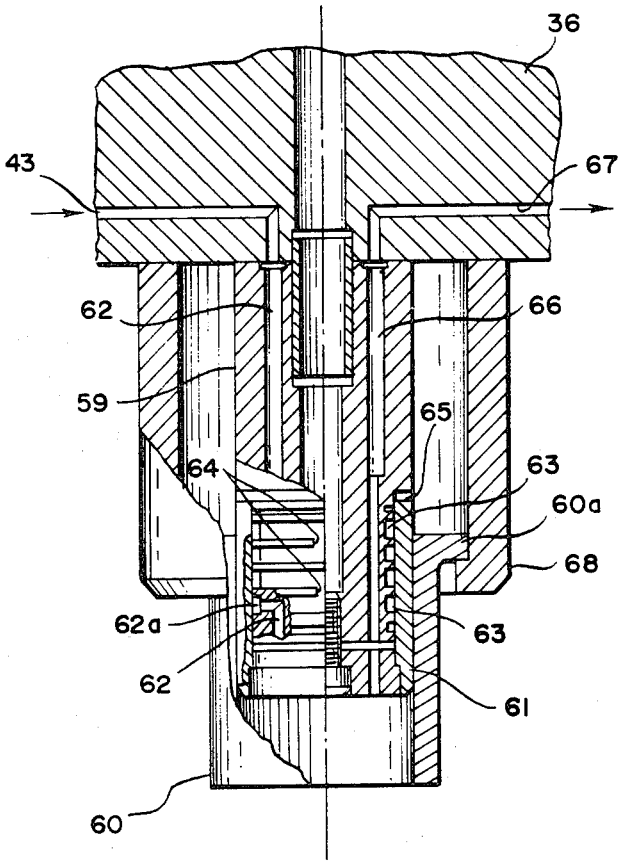
FIG. 4 is a partial side elevational view in cross section of an alternate punch design for the apparatus of FIG. 1.

FIG. 4 shows an alternate view of punch cooling passages. More specifically, the second redraw punch assembly is shown and the view is partially in section to disclose the details of the cooling passages through that assembly. In a manner similar to that described in FIG. 3, the coolant enters the punch shoe 36 through an inlet passage 43 moving thereacross and down into a punch base 59 being a cylindrical member disposed within a redraw sleeve 60 a continuing device for the can and pressure clamp. Redraw sleeve 60 is hollow and cylindrical and fits about the outer periphery of a carbide punch shell 61 which rides about a punch core 63 attached to the lower periphery of the cylindrical punch base 59. Redraw sleeve 60 has a retainer flange 60*a* which cooperates with a redraw sleeve retainer 68 carried on punch shoe 36. There are coolant passages in punch core 63 against the inside of carbide punch shell 61.

More specifically a passage 62 extends downwardly from inlet passage 43 into the punch base 59 and communicates by cross passage 62*a* with a series of spaced parallel circumferentially positioned grooves in punch core 63. Cross passage 62*a* permits coolant to flow into grooves of punch core 63. In order to establish a circuitous path about the outer periphery of punch core 63. There are a series of inner connections 64 between adjacent grooves of punch core 63 to permit the coolant to migrate from one groove to the next. As can be seen in FIG. 4, these interconnections 64 are alternately spaced on opposite sides of the punch base 59 such that the coolant must flow about the punch core 63 before it can reach another level and thus in a maze fashion coolant flow passes through the spaces formed by the grooves in punch core 63 and the inner connections 64 adjacent the inside wall of the carbide shell 61. An exit passage 65 interconnects the grooves with an outlet passage 66 which extends up through the punch base 59 to the punch shoe 36 and through an exit passage 67.

Figure 7:
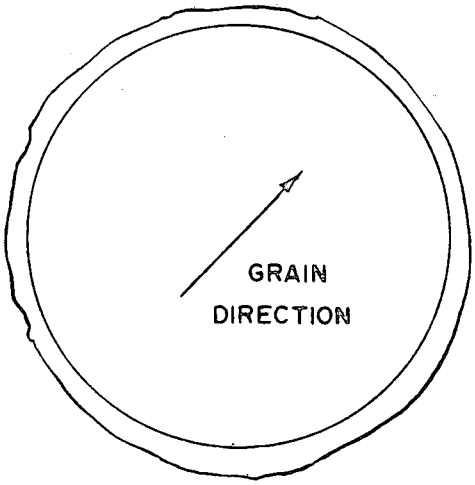
FIG. 7 is a plan view of a trim ring wherein the amount of material and distribution of same is considered normal.

In operation, the apparatus shown in FIG. 1 can be used as an experimental tool to determine the best method for producing containers having the ideal trim ring as shown and described with respect to FIG. 7, notwithstanding the fact that the material dimension i.e., thickness or specifications, i.e. temper will vary. For example, the following Example A discloses an arrangement wherein the die temperatures were checked with a contact pyrometer probe with and without cooling as can be seen. The temperatures varied and could be controlled by the flow of coolant.

EXAMPLE A

PARALLEL PATH COOLING

| | TEST 1 | TEST 2 |
|---|---|---|
| Exiting Can Temperature | 150–160° F. | 140–150° F. |
| Cupping Die Temperature | 115–120° F. | 75° F. |
| First Redraw Die Temperature | 95° F. | 85° F. |
| Second Redraw Die Temperature | 150° F. | 95° F. |
| First Redraw Sleeve (Clamp Sleeve) Temperature | 150° F. | 110° F. |
| Second Redraw Sleeve (Clamp Sleeve) Temperature | 150° F. | 100° F. |

Test 1 involved cooling of the second station (the first redraw) tooling only. The press ran at 80 strokes/minute and made cans from 75# T-4 plate.

Test 2 was a more representative experiment; all stations were cooled by tap water @ 55° F. and 35–40 psig supply pressure. (The supply pressure was also the total pressure drop across the system.) The press operated at 100 strokes/minute and made cans from 75# T-4 plate.

Similarly, an experiment wherein the water was run in series (not specifically shown and disclosed herein where the temperatures of the stations cannot be independently controlled) the coolant flows through one set of tooling after another before it is rechilled. For such an experiment inferior cooling was found.

Draw punch temperatures are unavailable because the clamp sleeve covered the punch surface and made it impossible to get the contact pyrometer probe to directly touch the punch.

SERIES PATH COOLING

| | |
|---|---|
| Cupping Die Temperature | 110° F. |
| First Redraw Die Temperature | 160° F. |
| Second Redraw Clamp Sleeve Temperature | 170° F. |
| First Redraw Sleeve Clamp Sleeve Temperature | 150° F. |
| Second Redraw Sleeve Clamp Sleeve Temperature | 200° F. |

All press conditions were not recorded, but the speed was 85 strokes/minute. The cooling was a series arrangement fed by tap water at the temperature and pressure mentioned previously.

It is clear that parallel feed is superior for minimizing operating temperature of the tooling. Tests 1 and 2 involved parallel-path cooling channels in which water from the supply cooled only one tool before being discharged from the press. The material used was also 75# T-4. No die temperature exceeded 170° F. and that no clamp sleeve exceeded 200° F.

Calculations as to the amount of heat which is removed can easily be made by measurement of the coolant temperatures before and after it has passed through the tooling provided that a steady state condition has been achieved. That is to say that, the tooling is running at an operating speed for a sufficient time to equalize the operating temperatures of all of the components and all of the piece parts. This was done in connection with the following Example B The amount of heat being removed from each tool by the coolant water was determined during a continuous run of the press. The coolant temperatures in each coolant passage reached a steady state, and the water flow rates and the water temperatures were measured so that the heat removal rates could be calculated. The results are as follows:

| | RATE OF HEAT REMOVAL (BTU/MIN) | WATER FLOW RATE (GAL/MIN) |
|---|---|---|
| Cupper Punch | 23 | 0.51 |
| First Redraw Punch | 34 | 0.37 |
| Second Redraw Punch | 36 | 0.27 |
| Cupper Die | 75 | 0.83 |
| First Redraw Die | 42 | 0.66 |
| Second Redraw Die | 37 | 0.89 |

SPEED OF PRESS: 80 STROKES/MINUTE
MATERIAL RUN: 75# T-4

The cupper die was found to have the greatest amount of heat removed from it by the coolant, perhaps because heat transfer is superior in that particular piece of tooling or because there is more heat being generated there. The amount of heat removed from each of the punches is roughly the same as that removed from its respective dies.

Once the concept was evolved as to how the independent cooling of the tooling for the various stations could best be applied, it was necessary to see what the commercial advantage would be and more specifically, how the adjustment to the flow of coolant could be used to accommodate plate variations, specifically plate gauge and temper variations and to adjust trim rings. The following Examples C, D and E show the results of a test made in connection with determining the effect of controlled cooling on adjusting the trim ring size and accommodating wide ranging gauge variations.

EXAMPLE C

The difference in flow rates between the punches and the dies should be noted. The flow path through the punches (see FIG. 3) presents much more resistance to flow than that through the dies.

The following test conditions have been tried on the press with the objective of determining the effect that various water cooling arrangements have on the amount of metal in the trim ring:

| DRAW DIE COOLED (STATIONS) | DRAW PUNCHES COOLED (STATIONS) |
|---|---|
| None | None |
| 1,2,3 | 1,2,3 |

In each test the press speed in strokes per minute was 80 and, marked panels of stock were inserted into the feed stack at set intervals. Matched cans and trim rings were saved and weighed to determine the percent of metal from the original blank which was used in the trim ring. The flow path was parallel such that the tooling 11, 12 and 13 could be independently cooled.

Figure 5:
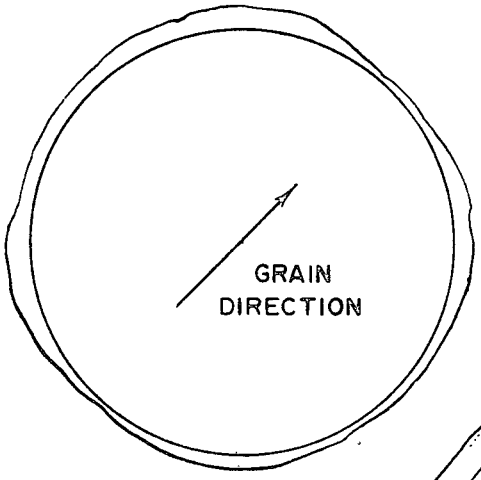
FIG. 5 is a plan view of a trim ring which is almost too thin or fragile for handling.

FIG. 5 shows a trim ring which is difficult to handle without jamming. That is to say that, the trim ring shown in FIG. 5 is narrowest in the area normal to the direction of grain established during mill rolling of the metal into a sheet form to make it thin enough to be used for drawing into cans. Similarly, the trim ring shown in FIG. 5 is widest at all points which are at angles which are at 45° relative to the grain direction. This widening is called earing. In the most severe case, the narrow areas shown in FIG. 5 could consist of no metal at all and thus represent a broken trim ring which is particularly difficult to handle in that the broken edges are sharp and do not cooperate with the equipment designed to help remove the trim ring from the press or because slivers or shards of metal from the broken portion jam the press and damage the tools.

Figure 6:
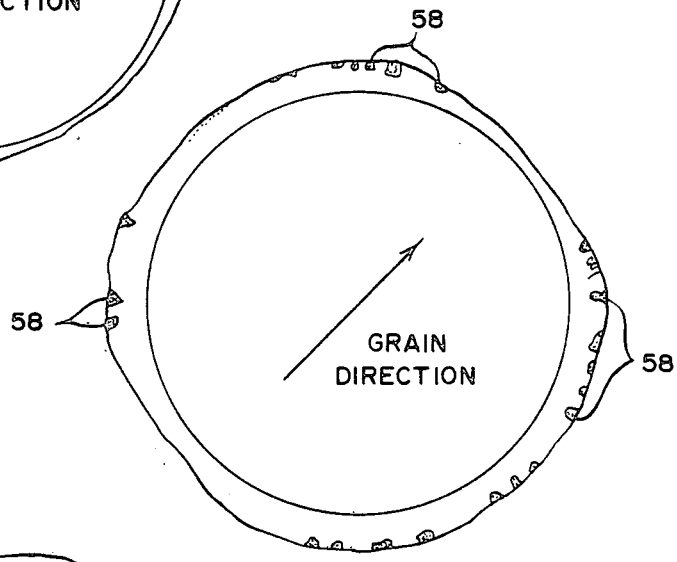
FIG. 6 is a plan view of a trim ring which has excess material such that it is uneconomical and difficult to handle.

In FIG. 6 a trim ring with excessive material is shown. This trim ring includes puckers at 58 which extend about the periphery of the trim ring. These puckered portions interfere with the drawing of the metal into the container wall during the cupping, first redraw, and second redraw with bottom profiling operations. The puckers tend to lock between the die and clamping portion of the tooling thus preventing metal flow into the container body. It is therefore important to minimize the radial extent of the trim ring such that the flow of metal is not inhibited by puckers. These puckers result from the circumferential contraction of metal as it is converted from a flat sheet or from a larger diameter container into a smaller diameter container when the metal is insufficiently clamped. Once again the trim ring even though excessive tends to be wider along lines at 45° to the direction of the grain as established during the rolling of the metal at the mill.

Finally, FIG. 7 shows a normal trim ring and while not circular about its outer circumferential periphery it is more nearly so than the trim rings of FIGS. 5 and 6. Here again, there is some narrowing in the areas normal to the direction of grain. This preferred trim ring has sufficient material to be easily handled without difficulties due to its size or fragilness. Again, the preferred trim ring of FIG. 7 does not have the puckers 58 shown in connection with the excessive trim ring in FIG. 6. Consequently, there is no inhibition to the flow of material during drawing or redrawing, and in particular, to the movement or flow of metal during the bottom profile operation wherein material has to be shifted into the bottom from the flange and side wall of the container. The trim rings from the test where water was supplied to all punches and rings had 27% more material than those of the test where there was no cooling. The exact values were:

| | RATIO OF TRIM RING WEIGHT TO ORIGINAL BLANK WEIGHT* | STANDARD DEVIATION |
|---|---|---|
| TEST WITH NO COOLING | .037 | .004 |
| TEST WITH COOLING OF ALL PUNCHES AND DIES | .047 | .004 |

(*Note: Original Blank Weight = weight of trim ring + weight of corresponding can body)

$$\% \text{ increase in trim ring material} = \frac{.047 - .037}{.037} = 27\%$$

EXAMPLE D

Results of can making tests of 65# DR9 gauge-temper for:

1. Process Set for Ideal Plate Thickness

Safe operating gauge range for coated plate: 0.0073" (−3.3%) to 0.0078" (+3.3%)

Water cooling flow rates (40° to 50° F. supply), gpm:

| Station | Punch | Die |
|---|---|---|
| Cupping | 0.4 | 1.0 |
| Second | 0.2 | 0.73 |
| Third | 0.25 | 0.20 |

2. Process Set for Heavy Gauge Plate

Safe operating limit for coated plate: Up to 0.0080" (+6.0%).

Water cooling flow rates (40° to 50° F. supply), gpm:

| Station | Punch | Die |
|---|---|---|
| Cupping | 0.60 | .57 |
| Second | 0.37 | .37 |
| Third | 0.35 | None |

The criticality of the trim ring control has been discussed in connection with FIGS. 5, 6 and 7. Data which exceeds the variation in trim ring material by weight in grams is disclosed in connection with some experiments used with coolant flow for varying conditions with varying types of plate i.e., light, ideal and heavy. It can be seen that the trim ring weights can be controlled to some extent notwithstanding the fact that the plate varies considerably.

EXAMPLE E

CONDITIONS TO INCREASE IRONING—LIGHT PLATE

| | PUNCHES | | | DIES | | |
|---|---|---|---|---|---|---|
| | 1 | 2 | 3 | 1 | 2 | 3 |
| TOOLING SURFACE TEMPERATURE °F. | 100 | 130 | 160 | 70 | 80 | 90 |
| WATER FLOW RATE (GPM) | .30 | .18 | .17 | 1.0 | 7.3 | .20 |
| CAN SURFACE TEMPERATURE (DEGREES F.) | | | 145 | | | |
| TRIM RING WEIGHT (GRS.) | | | 1.7 | | | |

INLET WATER TEMP. 45° F. AVG.

NORMAL CONDITIONS FOR IDEAL PLATE

| | PUNCHES | | | DIES | | |
|---|---|---|---|---|---|---|
| | 1 | 2 | 3 | 1 | 2 | 3 |
| TOOLING SURFACE TEMPERATURE °F. | 80 | 105 | 130 | 70 | 80 | 90 |
| WATER FLOW RATE (GPM) | .60 | .37 | .35 | 1.00 | .73 | .20 |
| CAN SURFACE TEMPERATURE (DEGREES F.) | | | 130 | | | |
| TRIM RING WEIGHT (GRS.) | | | 1.7 | | | |

INLET WATER TEMP. 45° AVG.

CONDITIONS TO DECREASE IRONING—HEAVY PLATE

| | PUNCHES | | | DIES | | |
|---|---|---|---|---|---|---|
| | 1 | 2 | 3 | 1 | 2 | 3 |
| TOOLING SURFACE TEMPERATURE °F. | 80 | 105 | 130 | 90 | 105 | 120 |
| WATER FLOW RATE (GPM) | .60 | .37 | .35 | .50 | .36 | .10 |
| CAN SURFACE TEMPERATURE (DEGREES F) | | | 135 | | | |
| TRIM RING WEIGHT (GRS.) | | | 1.7 | | | |

INLET WATER TEMP 45° F. AVG.

Those skilled in the art will no doubt appreciate that variations on the specific coolant passage configurations could be applied to a variety of tooling in order to make a system wherein the tooling dimensions could be controlled in accordance with the desired results of the fabricating process.

The claims which follow are fashioned to cover those arrangements which skilled artisan would develope through the knowledge of the teachings of the present disclosure even though the exact configurations or the particular operation to which it has been adapted are not followed.

What is claimed is:

1. In an apparatus for drawing and ironing a container from material without coolant being applied directly to said material including a press frame for supporting tooling for reciprocating movement where said tooling includes punch means and die means for drawing and ironing said material captured therebetween into a thin walled hollow container having a cup-shape, the improvement comprising:

adjacent surfaces on said punch and die means for defining a space therebetween through which said material must pass during forming;

coolant passages provided in said die means for permitting coolant to flow therethrough without said coolant contacting said material;

flow regulating means associated with said die means coolant passages for adjusting the rate of said coolant allowed to pass through said die means in accordance with variations in said material and to effect said space, between said adjacent surfaces by increasing or decreasing said die means surface position toward or away from said punch means surface; and temperature control means connected to said die means passages to change the temperature of said coolant in accordance with variations in said material and to effect said space, between said adjacent surfaces by increasing or decreasing said die means surface position toward or away from said punch means surface.

2. The apparatus of claim 1 wherein said punch means has coolant passages connected independently of said die means passages and another flow regulating means being connected to said punch means passages.

3. The apparatus of claim 1 wherein said punch means has coolant passages independent of said die means passages and another temperature control means being connected to said punch means passages.

4. In an apparatus for drawing and ironing a cup with a peripheral flange from relatively thin material into an elongated container also having a flange by moving a die and punch relative to one another and draw clamping and centering sleeve coaxial therewith and thereafter applying a bottom forming member axially relative to the die against the punch to profile shape said container bottom without the benefit of coolant flooding of said material during drawing and ironing, the improvement comprising;

a die means of a predetermined shape and size carried in the apparatus, a punch means of a predetermined shape and size for cooperating with said die means and each having surfaces which define a clearance therebetween during forming of said material;

separate passages through said die means and said punch means to permit flow of coolant;

a coolant supply means independently connected to said die means and said punch means passages;

valving in line with said die means and said punch means passages for independent control of the coolant flow from said supply means to said die means and said punch means to permit regulation of the operating temperature of said die means with respect to said punch means to increase or decrease said clearance therebetween by moving said surfaces toward or away from one another during the drawing and ironing of said material into an elongated container.

5. The apparatus of claim 4 wherein said die and punch passages each have independent temperature controlling means for varying the operating temperature of the coolant flowing through said passages to said die and punch means with respect to one another.

6. The apparatus of claim 5 wherein said temperature controlling means is between said valving and said passages for said die to change the temperature of said coolant for said die.

7. The apparatus of claim 5 wherein said temperature controlling means is between said valving and said passages for said punch to change the temperature of said coolant for said punch.

* * * * *